US010750794B2

(12) United States Patent
Van Tiel et al.

(10) Patent No.: US 10,750,794 B2
(45) Date of Patent: Aug. 25, 2020

(54) FOOTLET

(71) Applicant: STEPS HOLDING B.V., Oost West en Middelbeers (NL)

(72) Inventors: Cornelius Hendrikus Nicolaas Van Tiel, Middelbeers (NL); Wilhelmus Jacobus Cornelius Van Tiel, Middelbeers (NL)

(73) Assignee: STEPS HOLDING B.V., Oost West en Middelbeers (NL)

( * ) Notice: Subject to any disclaimer, the term of this patent is extended or adjusted under 35 U.S.C. 154(b) by 0 days.

(21) Appl. No.: 14/896,365

(22) PCT Filed: Jul. 1, 2014

(86) PCT No.: PCT/IB2014/062765
§ 371 (c)(1),
(2) Date: Dec. 4, 2015

(87) PCT Pub. No.: WO2015/001482
PCT Pub. Date: Jan. 8, 2015

(65) Prior Publication Data

US 2016/0120233 A1 May 5, 2016

(30) Foreign Application Priority Data

Jul. 4, 2013 (NL) ..... 2011104

(51) Int. Cl.
*A41B 11/12* (2006.01)
*A43B 1/04* (2006.01)
(Continued)

(52) U.S. Cl.
CPC ..... *A41B 11/126* (2013.01); *A41B 11/121* (2013.01); *A41B 11/128* (2013.01);
(Continued)

(58) Field of Classification Search
CPC ... A41B 11/126; A41B 11/121; A41B 11/128; A41B 2500/10; A43B 1/04; A43B 13/22;
(Continued)

(56) References Cited

U.S. PATENT DOCUMENTS 2,339,963 A * 1/1944 St Pierre ..... D04B 9/54 66/173
3,146,468 A * 9/1964 McDonald ..... A41B 11/121 2/239

(Continued)

FOREIGN PATENT DOCUMENTS

CN 101646817 A 2/2010
CN 201515695 U 6/2010

(Continued)

OTHER PUBLICATIONS

The Engineering ToolBox, Friction and Friction Coefficients, (2004). https://www.engineeringtoolbox.com/friction-coefficients-d_778.html (Year: 2004).*

(Continued)

*Primary Examiner* — Alissa J Tompkins
*Assistant Examiner* — Cameron A Carter
(74) *Attorney, Agent, or Firm* — Ladas & Parry, LLP

(57) ABSTRACT

A footlet (1) is provided with a heel portion (2), a toe portion (6) and a middle portion (4) interposed between the heel portion and the toe portion. The middle portion comprises lateral sides extending between the heel portion and the toe portion on either side. The footlet is completely manufactured by reciprocating knitting. The heel portion is provided with a thread comprising an anti-slip agent, which thread is incorporated in the heel portion by knitting.

22 Claims, 5 Drawing Sheets

(51) Int. Cl.

| | |
|---|---|
| ***A43B 13/22*** | (2006.01) |
| ***A43B 13/28*** | (2006.01) |
| ***A43B 13/34*** | (2006.01) |
| ***A43B 13/37*** | (2006.01) |
| ***A43B 17/16*** | (2006.01) |
| ***A43B 17/18*** | (2006.01) |
| ***A43B 17/00*** | (2006.01) |
| ***D04B 1/26*** | (2006.01) |

(52) U.S. Cl.
CPC ..... *A43B 1/04* (2013.01); *A43B 13/22* (2013.01); *A43B 13/28* (2013.01); *A43B 13/34* (2013.01); *A43B 13/37* (2013.01); *A43B 17/00* (2013.01); *A43B 17/16* (2013.01); *A43B 17/18* (2013.01); *D04B 1/26* (2013.01); *A41B 2500/10* (2013.01)

(58) Field of Classification Search
CPC ..... A43B 13/28; A43B 13/34; A43B 13/37; A43B 17/16; A43B 17/18
USPC ..... 2/239, 240, 241, 242
See application file for complete search history.

(56) References Cited

U.S. PATENT DOCUMENTS

| | | | | | |
|---|---|---|---|---|---|
| 3,729,956 | A | | 5/1973 | Nebel | |
| 3,983,870 | A | * | 10/1976 | Herbert | A41B 11/12 2/240 |
| 4,546,493 | A | * | 10/1985 | Bortnick | A41D 7/00 139/420 R |
| 6,782,720 | B2 | * | 8/2004 | Vero | A41D 19/01505 66/171 |
| 7,473,816 | B2 | * | 1/2009 | Hall | A61F 13/08 602/41 |
| 7,748,240 | B1 | * | 7/2010 | Cherneski | A41B 11/008 2/239 |
| 8,057,887 | B2 | * | 11/2011 | Morin | D03D 15/0011 428/221 |
| 8,424,116 | B2 | * | 4/2013 | Anastsopoulos | A41B 11/003 2/239 |
| 2006/0179546 | A1 | * | 8/2006 | Ko | A41B 11/04 2/239 |
| 2006/0253961 | A1 | * | 11/2006 | Chan | A41B 11/02 2/239 |
| 2006/0260024 | A1 | * | 11/2006 | Lee | A41B 11/128 2/239 |
| 2009/0018482 | A1 | * | 1/2009 | Lambertz | A41B 11/003 602/65 |
| 2009/0044313 | A1 | * | 2/2009 | Anastsopoulos | A41B 11/003 2/241 |
| 2009/0288451 | A1 | * | 11/2009 | Yokoyama | A41B 11/004 66/185 |
| 2010/0037370 | A1 | * | 2/2010 | Busi | D04B 1/108 2/239 |
| 2012/0058316 | A1 | * | 3/2012 | Cherneski | A41B 17/00 428/197 |

FOREIGN PATENT DOCUMENTS

| | | | |
|---|---|---|---|
| DE | 102006033393 | A1 | 1/2008 |
| EP | 0632972 | A1 | 1/1995 |
| EP | 3016534 | B1 | 11/2017 |
| JP | 53-120524 | U | 9/1978 |
| JP | H07-015703 | U | 3/1995 |
| JP | 2002-526665 | | 8/2002 |
| RU | 2666680 | C2 | 9/2018 |
| WO | 00/19846 | | 4/2000 |
| WO | 03/008685 | A1 | 1/2003 |
| WO | 2008/072048 | A1 | 11/2007 |
| WO | 2015/001482 | | 1/2015 |

OTHER PUBLICATIONS

ISR for PCT/IB2014/062765 dated Oct. 28, 2014.
Written Opinion for PCT/IB2014/062765 dated Oct. 28, 2014.
IPRP for related PCT/IB2014/062765 dated Jan. 5, 2016.
Office action from Chinese Patent Application No. 201480032577.9 dated Oct. 23, 2017, and its English translation.
Office action from Japanese Patent Application No. 2016-522947 dated Jun. 26, 2018, and its English translation.
Office action from Korean Patent Application No. 10-2015-7036381 dated Apr. 27, 2020, and its English translation.
Office action from Chinese Patent Application No. 201480032577.9 dated May 12, 2017, and its English translation.

* cited by examiner

FOOTLET

CROSS-REFERENCE TO RELATED APPLICATIONS

This application is the U.S. National Stage of International Patent Application No. PCT/IB2014/062765 filed on Jul. 1, 2014, which claims priority to and the benefit of Netherlands Patent Application 2011104 filed on Jul. 4, 2013, the disclosures of which are hereby incorporated by reference in their entireties.

The invention relates to a footlet provided with a heel portion, a toe portion, and a middle portion located between the heel portion and the toe portion, which middle portion comprises lateral sides that extend between the heel portion and the toe portion on either side, said footlet being manufactured completely by means of reciprocating knitting.

Such a footlet is known from WO2008072048A1 and is used for partly covering a person's foot. The footlet, when worn, extends over the heel and the lower side of the foot and over the toes. The middle portion then also extends somewhat along the lateral sides of the foot. The upper side of the foot is not covered by the footlet. When open shoes are worn, the footlet is hidden from view by the shoe and affords the wearer a comfortable feeling.

It is a disadvantage of the known footlet that there is a risk of the footlet being shifted off the foot during walking by the frictional contact between the heel portion and the inner side of the shoe, which is undesirable.

The invention has for its object to provide a footlet that is easy to manufacture and that remains firmly in contact with the foot during use.

This object is achieved with the footlet according to the invention in that the heel portion is provided with a thread that comprises an anti-slip agent, which thread is incorporated in the heel portion by reciprocating knitting.

A footlet with an increased coefficient of friction between a person's foot and the heel portion is achieved in a simple manner by means of the thread provided with an anti-slip agent and incorporated in the heel portion by knitting, so that the risk of the footlet sliding off the foot is reduced. Since the footlet is manufactured by continuous reciprocating knitting, a footlet is obtained as an uninterrupted whole without stitched seams, and the footlet is provided with its thread comprising an anti-slip agent during the very manufacturing process thereof.

It is noted that footlets are known wherein an anti-slip agent is provided at the inner side, for example by spraying or painting, or wherein a strip of anti-slip material is provided by gluing. The application of an anti-slip agent in this manner requires an additional manufacturing step, which renders the footlet comparatively expensive. It also involves a risk that a footlet inadvertently fails to be provided with the anti-slip agent during the additional manufacturing step. Furthermore, the anti-slip agent is provided at a distance from the upper side of the heel portion in this case, so that the section of the heel portion located between the upper side thereof and the anti-slip agent can still slide down.

An embodiment of the footlet according to the invention is characterized in that the anti-slip agent comprises an elastomer, such as silicones.

Silicones can be in contact with the foot for long periods without causing irritation. In addition, silicones are flexible so that they can be readily deformed along with the footlet when the latter is slid over a person's foot. The coefficient of friction can be increased also by means of alternative elastomers.

A further embodiment of the footlet according to the invention is characterized in that the anti-slip agent is provided on a carrier thread of a natural or synthetic material.

It is possible in this manner to manufacture comparatively thin carrier threads provided with, for example, silicones.

The carrier thread may be, for example, of nylon or cotton of, for example, 22 decitex. The carrier thread/silicone ratio may be, for example, 50/50.

A further advantage of the use of a carrier thread is that the carrier thread can be manufactured from a cheaper material than the anti-slip agent, so that the cost of the thread comprising the anti-slip agent is comparatively low.

A further embodiment of the footlet according to the invention is characterized in that the heel portion is provided with a knitted edge portion forming a collar, said edge portion being provided with the thread comprising the anti-slip agent.

Since the edge portion is provided with the thread comprising the anti-slip agent, it is prevented that the edge portion, and accordingly the entire heel portion, will slide relative to the foot.

A further embodiment of the footlet according to the invention is characterized in that the edge portion is folded over such that the edge portion comprises a first edge sub-portion facing the toe portion and a second edge sub-portion remote from the toe portion.

Such a folded edge portion provides a comparatively thick, sturdy collar.

A further embodiment of the footlet according to the invention is characterized in that of the edge portion only the first edge sub-portion facing the toe portion is provided with the thread comprising the anti-slip agent.

The coefficient of friction between the foot and the first edge sub-portion is enlarged thereby. The second edge sub-portion, which is not provided with the anti-slip agent, can move relative to the inner side of the shoe with a comparatively low coefficient of friction during walking.

A further embodiment of the footlet according to the invention is characterized in that the heel portion is knitted at least in part with at least two threads, wherein one of the at least two threads is the thread comprising the anti-slip agent.

The use of more than one thread leads to a desired thickness of the collar. The other one of the at least two threads, moreover, may be provided with another desired property of the heel portion.

A further embodiment of the footlet according to the invention is characterized in that another one of said at least two threads is an elastic thread.

Since the elastic thread and the thread comprising the anti-slip agent are jointly knitted, the relevant heel portion is simultaneously provided with elastic and anti-slip properties.

A further embodiment of the footlet according to the invention is characterized in that the thread comprising the anti-slip agent is located mainly at a side of the heel portion facing the toe portion, while another one of the at least two threads is located mainly at a side of the heel portion remote from the toe portion.

In this manner only the side of the heel portion facing the toe portion is given the anti-slip agent that increases the coefficient of friction.

A further embodiment of the footlet according to the invention is characterized in that the thread comprising the anti-slip agent is provided over a portion of the heel.

The thread comprising the anti-slip agent may be provided in the edge portion or at a distance thereto in the heel portion. The desired position can be determined experimentally.

The invention will now be explained in more detail with reference to a drawing, in which:

Corresponding parts have been given the same reference numerals in the figures.

FIG. 1 shows a footlet 1 according to the invention manufactured on a knitting machine with reciprocating knitting movements only.

Figure 1:
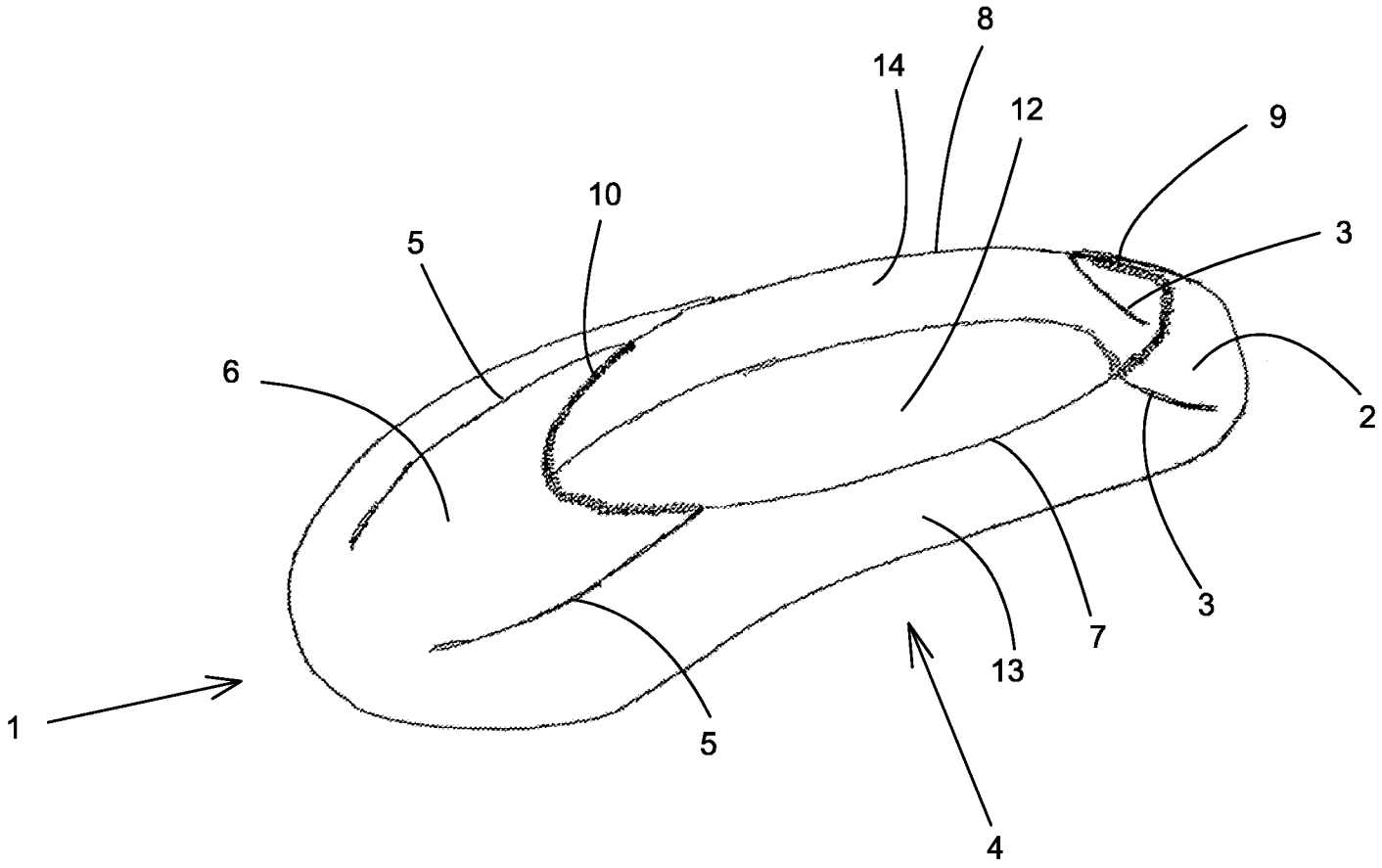
FIG. 1 is a perspective view of a footlet according to the invention.

The footlet 1 is provided with a heel portion 2, a middle portion 4 connected to the heel portion 2 via lines 3 formed by knitting, and a toe portion 6 connected to the middle portion 4 via lines 5 formed by knitting. The desired shape of the footlet 1 can be obtained through increasing and decreasing during the reciprocating knitting process. The middle portion 4 comprises lateral sides 7, 8 that extend between the heel portion 2 and the toe portion 6 on either side. The footlet 1 is further provided with a first edge sub-portion 9 located adjacent the heel portion 2 and a second edge sub-portion 10 located adjacent the toe portion 6. A method of manufacturing such a footlet 1 is described in WO2008072048A1.

Figure 2:
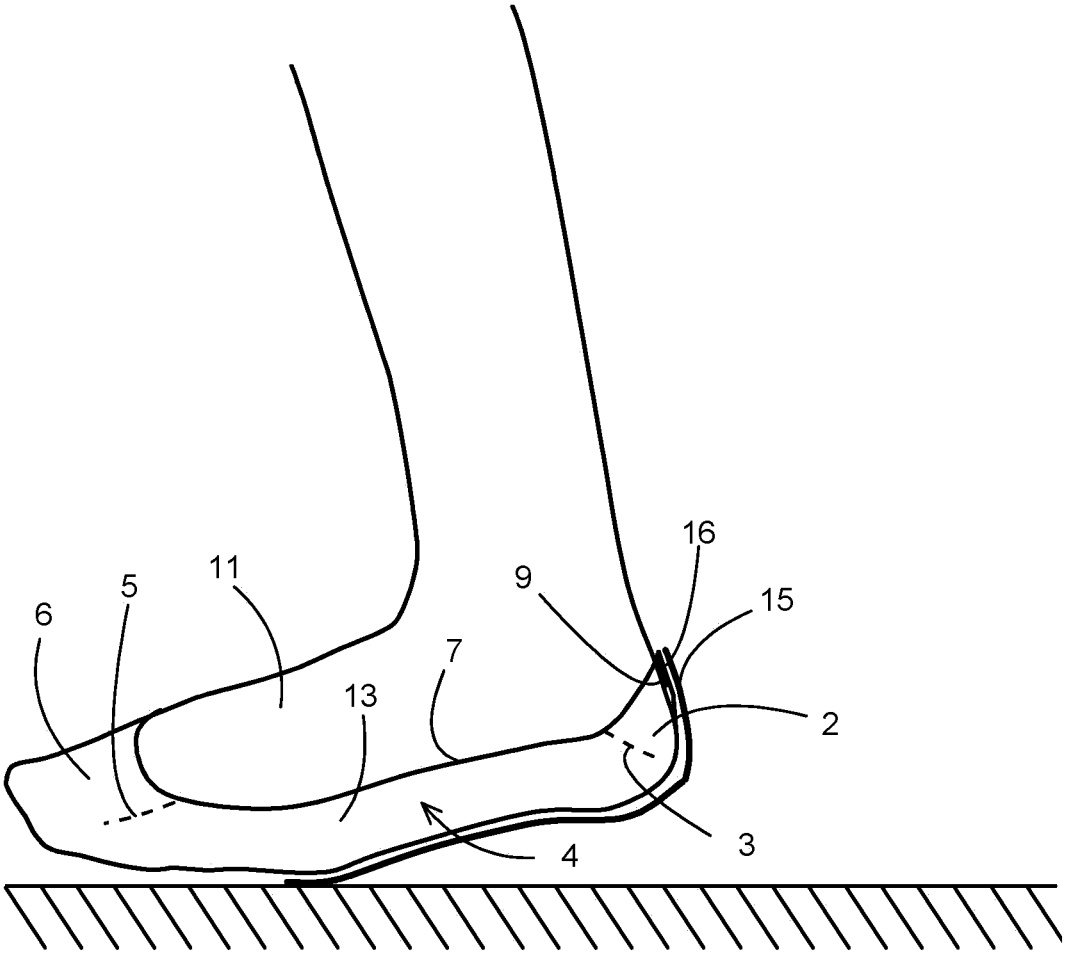
FIG. 2 is a side elevation of the footlet of FIG. 1 provided around a person's foot, said foot being present in a shoe.

FIG. 2 shows a person's foot 11 fitted with the footlet 1 of FIG. 1. The heel portion 2 is laid around the heel of the foot 11 here. The toe portion 6 lies over the toes of the foot 11. The middle portion 4 extends with a bottom portion 12 along the lower side of the foot 11 and with lateral portions 13, 14 along the lateral sides of the foot 11. The foot 11 lies with the footlet 1 around it inside a shoe 15 of which only a portion is shown for reasons of clarity.

The heel portion 2 is provided with a thread (see FIGS. 3A, 3B) comprising an anti-slip agent, preferably over an edge portion 16, which thread was provided during the knitting of the footlet 1. The thread comprising an anti-slip agent was provided in the heel portion 2 by means of knitting. The thread is preferably composed of a carrier thread of a natural or synthetic material, such as cotton or nylon, on which silicones were provided as the anti-slip agent.

The thread preferably has a substantially circular cross-section, the carrier thread having a first diameter and the total thread comprising the anti-slip agent having a larger, second diameter. The ratio of the first diameter to the second diameter is such that the surface area of the cross-section of the carrier thread accounts for approximately half the surface area of the cross-section of the complete thread comprising the anti-slip agent.

The manufacture of such a thread comprising an anti-slip agent is known per se and will accordingly not be dealt with in any detail.

Figure 3A:
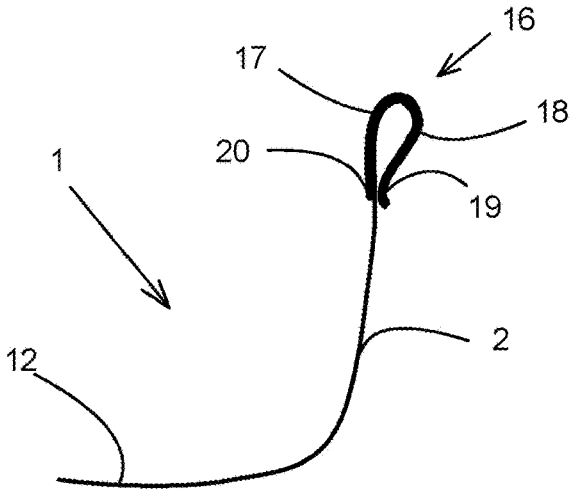
FIGS. 3A-3C, 4A-4C and 5A-5B are partial cross-sectional views of various embodiments of a heel portion of a footlet according to the invention.
Figure 3B:
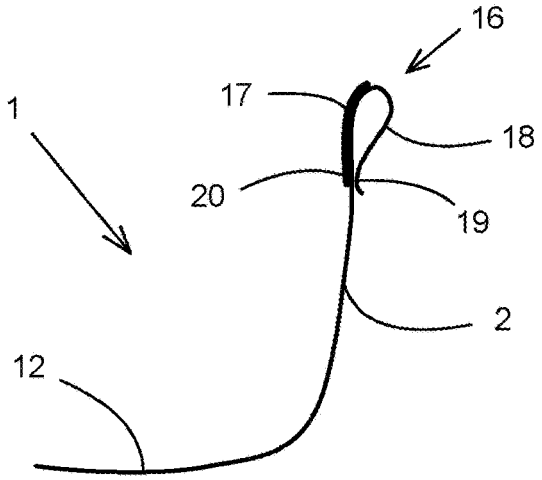
Figure 3C:
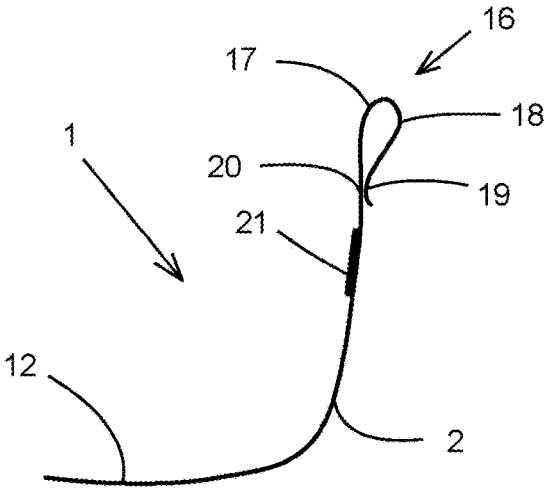

The FIGS. 3A-3C show three different embodiments of the footlet 1 wherein the heel portion 2 is provided with a knitted edge portion 16 that constitutes a collar. The edge portion 16 is folded over such that the edge portion 16 comprises a first edge sub-portion 17 facing the toe portion 6 and a second edge sub-portion 18 remote from the toe portion 6. During knitting of the edge portion 16, the second edge sub-portion 18 is knitted first and after that the first edge sub-portion 17. As soon as the first edge sub-portion 17 has been formed, the end 19 of the second edge sub-portion 18 is joined to the end 20 of the first edge sub-portion 17 by knitting. Then the remaining portion of the heel portion 2 and the footlet 1 is knitted.

In the embodiment of the footlet 1 shown in FIG. 3A, the thread comprising the anti-slip agent and an elastic thread are knitted simultaneously with the knitting of the second edge sub-portion 18 and the first edge sub-portion 17. The elastic thread is made of, for example, a polyurethane such as Lycra, Elastan, Dorlastan or Spandex. The elastic thread leads to the creation of an elastic edge portion 16 by which the footlet 1 is pressed against the foot 11. The anti-slip agent, such as silicones. effectively prevents slipping between the foot 11 and the edge portion 16, i.e. the heel portion 2 joined thereto.

In the embodiment of the footlet 1 shown in FIG. 3B, the thread comprising the anti-slip agent and the elastic thread are knitted simultaneously with the knitting of the first edge sub-portion 17 only. For the second edge sub-portion 18 only the elastic thread is used.

Less silicone material is necessary in this way. In addition, the thread comprising the anti-slip agent lies against the foot 11 only, whereas the comparatively smooth elastic thread lies against the inner side of the shoe 15.

In the embodiment of the footlet 1 shown in FIG. 3C, a portion 21 located at a distance to the edge portion 16 is knitted either with the thread comprising the anti-slip agent only or with the thread comprising the anti-slip agent and the thread with which the rest of the heel portion 2 is knitted. This thread may be of nylon, cotton or any other material, as desired.

If the portion 21 is knitted with more than one thread, this is preferably done such that the thread comprising the anti-slip agent is located mainly at a side of the heel portion 2 that faces the toe portion 6 while the other thread is mainly located at a side of the heel portion 2 remote from the toe portion 6. Such a knitting technique is known per se and will accordingly not be explained in any detail.

Figure 4A:
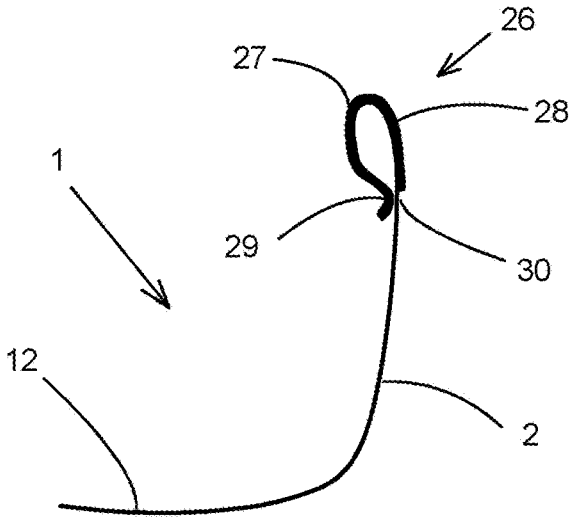
Figure 4B:
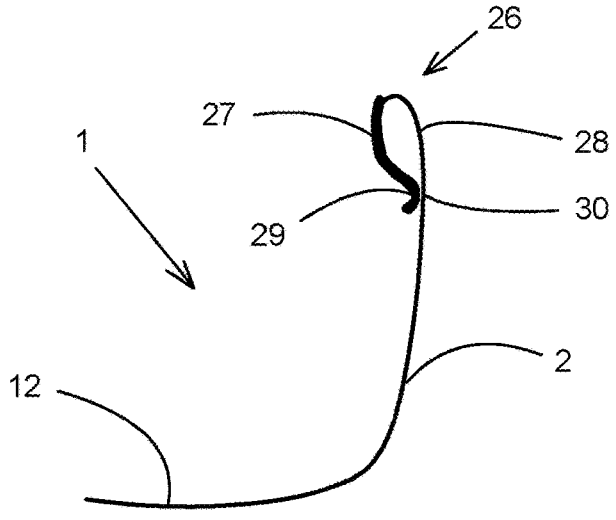
Figure 4C:
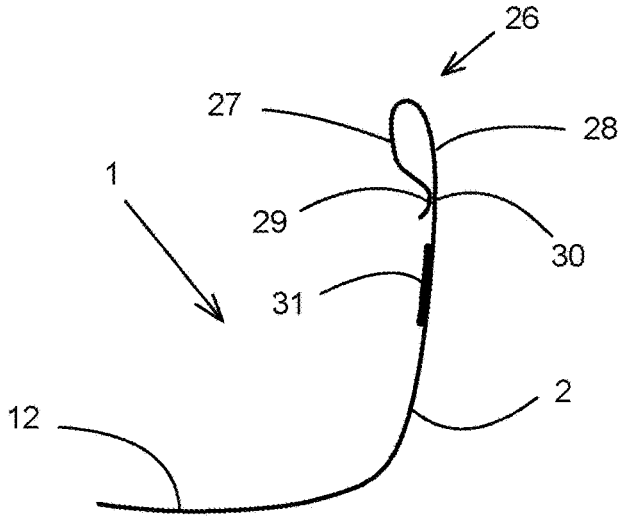

The FIGS. 4A-4C show three alternative embodiments of the footlet 1 wherein the heel portion 2 is provided with a knitted edge portion 26 that forms a collar. The edge portion 26 is folded over such that the edge portion 26 comprises a first edge sub-portion 27 facing the toe portion 6 and a second edge sub-portion 28 remote from the toe portion 6. During knitting of the edge portion 26, the first edge sub-portion 27 is knitted first and after that the second edge sub-portion 28. As soon as the second edge sub-portion 28 has been formed, the end 29 of the first edge sub-portion 27 is joined to the end 30 of the second edge sub-portion 28 by knitting. Then the remaining portion of the heel portion 2 and the footlet 1 is knitted.

In the embodiment of the footlet 1 shown in FIG. 4A, the thread comprising the anti-slip agent and an elastic thread are knitted simultaneously with the knitting of the first edge sub-portion 27 and the second edge sub-portion 28.

In the embodiment of the footlet 1 shown in FIG. 4B, the thread comprising the anti-slip agent and the elastic thread are knitted simultaneously with the knitting of the first edge sub-portion 27 only. For the second edge sub-portion 28 the elastic thread is only used.

In the embodiment of the footlet 1 shown in FIG. 4C, a portion 31 located at a distance to the edge portion 26 is knitted either with the thread comprising the anti-slip agent only or with the thread comprising the anti-slip agent and the thread with which the rest of the heel portion 2 is knitted.

Figure 5A:
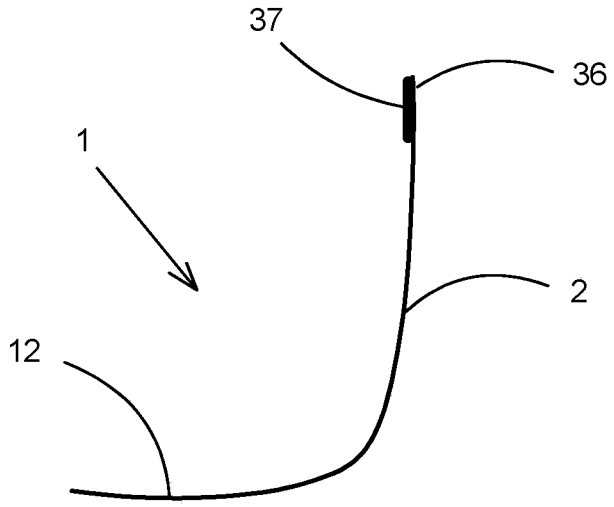
Figure 5B:
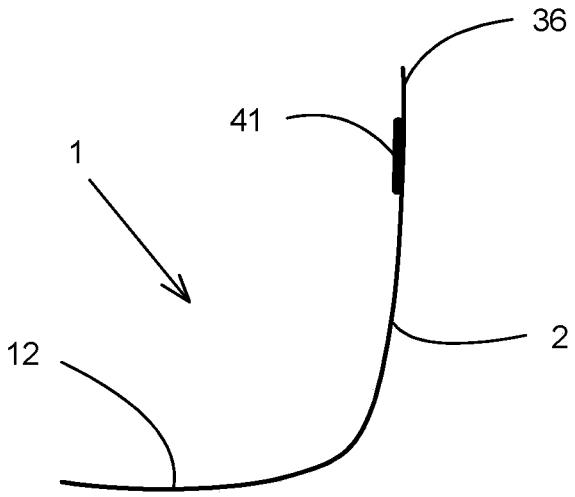

The FIGS. 5A-5B show two further embodiments of the footlet 1 wherein the heel portion 2 is provided with a knitted edge portion 36 that comprises a single edge sub-portion 37 that forms a collar.

In the embodiment of the footlet 1 shown in FIG. 5A, the thread comprising the anti-slip agent and an elastic thread are knitted simultaneously with the knitting of the edge sub-portion 37.

In the embodiment of the footlet 1 shown in FIG. 5B, a portion 41 located at a distance to the edge portion 36 is knitted either with the thread comprising the anti-slip agent only or with the thread comprising the anti-slip agent and the thread with which the rest of the heel portion 2 is knitted.

It is also possible to manufacture the footlet 1 entirely or partly by means of circular knitting. This has the disadvantage, however, that stitched seams are unavoidable.

It is possible to use alternative materials instead of silicones.

LIST OF REFERENCE NUMERALS

1. footlet
2. heel portion
3. line formed by knitting
4. middle portion
5. line formed by knitting
6. toe portion
7. lateral side
8. lateral side
9. edge portion
10. edge portion
11. foot
12. bottom portion
13. lateral portion
14. lateral portion
15. shoe
16. edge portion
17. first edge sub-portion
18. second edge sub-portion
19. end
20. end
21. portion
26. edge portion
27. first edge sub-portion
28. second edge sub-portion
29. end
30. end
31. portion
36. edge portion
37. edge sub-portion
41. portion

The invention claimed is:

1. A footlet comprising: a heel portion, a toe portion, and a middle portion located between the heel portion and the toe portion, wherein the middle portion comprises: lateral sides that extend between the heel portion and the toe portion on either side, wherein said footlet being manufactured completely by means of reciprocating knitting, and wherein the heel portion comprises a total thread that comprises an anti-slip agent, the total thread that comprises the anti-slip agent further comprising a carrier thread having a first diameter and the total thread that comprises the anti-slip agent having a second diameter, the second diameter being larger than the first diameter which total thread is incorporated in the heel portion by reciprocating knitting, and a cross-section of the total thread has a first portion that is the carrier thread and a second portion that is the anti-slip agent.

2. A footlet according to claim 1, wherein the anti-slip agent comprises an elastomer, such as silicones.

3. A footlet according to claim 1, wherein the total thread that comprises the anti-slip agent comprises the carrier thread of a natural or synthetic material.

4. A footlet according to claim 1, wherein the heel portion comprises a knitted edge portion that forms a collar, said edge portion comprising with the total thread comprising the anti-slip agent.

5. A footlet according to claim 4, wherein said edge portion is folded over such that the edge portion comprises a first edge sub-portion facing the toe portion and a second edge sub-portion remote from the toe portion.

6. A footlet according to claim 5, wherein of the edge portion, only the first edge sub-portion facing the toe portion comprises the total thread comprising the anti-slip agent.

7. A footlet according to claim 1, wherein the heel portion is knitted at least in part with at least two threads, wherein one of said at least two threads is the total thread comprising the anti-slip agent.

8. A footlet according to claim 7, wherein another one of said at least two threads is an elastic thread.

9. A footlet according to claim 7, wherein the total thread comprising the anti-slip agent is located mainly at a side of the heel portion facing the toe portion, while another one of the at least two threads is located mainly at a side of the heel portion remote from the toe portion.

10. A footlet according to claim 1, wherein the total thread comprising the anti-slip agent is located over a portion of the heel.

11. The footlet of claim 1, wherein the total thread comprising the anti-slip agent is incorporated in the heel portion by reciprocating knitting when the heel portion is being knitted.

12. The footlet of claim 1, wherein the anti-slip agent comprises silicone.

13. A footlet according to claim 1, wherein the carrier thread is a synthetic material.

14. A footlet according to claim 1, wherein the carrier thread has a circular cross-section of the first diameter and the total thread that comprises anti-slip agent has a circular cross-section of the second diameter.

15. A footlet comprising: a heel portion; a toe portion; and a middle portion located between the heel portion and the toe portion, which middle portion comprises lateral sides that extend between the heel portion and the toe portion on either side, wherein the footlet being manufactured completely by reciprocating knitting, wherein the heel portion consists essentially of knitted threads and the knitted threads comprise a total thread comprising an anti-slip agent, wherein the total thread comprising the anti-slip agent comprises the anti-slip agent when the total thread is incorporated in the heel portion by the reciprocating knitted, and a cross-section of the total thread has a first portion that is the carrier thread and a second portion that is the anti-slip agent.

16. A footlet according to claim 15, wherein the total thread comprising the anti-slip agent is a carrier thread of a natural or synthetic material having the anti-slip agent thereon.

17. The footlet of claim 15, wherein the total thread comprising the anti-slip agent is incorporated in the heel portion by reciprocating knitting when the heel portion is being knitted.

18. The footlet of claim 1, wherein the heel portion consists essentially of knitted threads.

19. The footlet of claim 1, wherein the heel portion consists of knitted threads.

20. The footlet of claim 1, wherein the anti-slip agent is only present in the heel portion.

21. The footlet of claim 1, wherein the anti-slip agent is not provided by spraying, painting or gluing the anti-slip agent to the footlet.

22. The footlet of claim 15, wherein no anti-slip agent is sprayed, painted or glued to the footlet after knitting.

* * * * *